US006289654B1

(12) United States Patent
Yamaguchi et al.

(10) Patent No.: US 6,289,654 B1
(45) Date of Patent: Sep. 18, 2001

(54) METHOD OF MANUFACTURING AN INK CARTRIDGE FOR USE IN INK-JET RECORDER

(75) Inventors: Shuichi Yamaguchi; Toshio Ito; Masahide Matsuyama; Yasuhiro Ogura; Fuminori Doi; Masanori Kamijo; Hisashi Koike; Takeo Yamaguchi; Hideo Fujimori, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/523,265

(22) Filed: Mar. 10, 2000

Related U.S. Application Data

(62) Division of application No. 09/306,651, filed on May 6, 1999, which is a division of application No. 08/969,326, filed on Nov. 13, 1997, now Pat. No. 5,950,403.

(30) Foreign Application Priority Data

Nov. 14, 1996 (JP) ..... 8-318695
May 7, 1997 (JP) ..... 9-132918

(51) Int. Cl.[7] ..... B65B 31/02; B65B 1/24

(52) U.S. Cl. ..... 53/434; 53/436; 53/469; 53/289

(58) Field of Search ..... 53/434, 436, 486, 53/449, 459, 469, 242, 289, 133.2; 141/113; 215/2

(56) References Cited

U.S. PATENT DOCUMENTS

| | | | | |
|---|---|---|---|---|
| 2,339,896 | * | 1/1944 | Waters | 53/289 |
| 3,488,915 | * | 1/1970 | Delestatius | 53/526 |
| 4,843,796 | * | 7/1989 | Furukawa | 53/434 |
| 5,170,609 | * | 12/1992 | Bullock et al. | 53/434 |
| 5,241,804 | * | 9/1993 | Tsuruta et al. | 53/326 |
| 5,906,568 | * | 5/1999 | Sato et al. | 53/133.2 |

FOREIGN PATENT DOCUMENTS

| | | | | |
|---|---|---|---|---|
| 07002233 | * | 6/1995 | (JP) | 53/526 |

* cited by examiner

*Primary Examiner*—John Sipos
(74) *Attorney, Agent, or Firm*—Stroock & Stroock & Lavan LLP

(57) ABSTRACT

A method of manufacturing an ink cartridge for use in an ink jet recorder, comprising the step of providing an ink bag having a top end, and a bottom end below the top end, the top end being open and the bottom end having an ink feed port therein; moving the ink bag from a first position near a top edge thereof and positioning the ink bag in a vacuum chamber; depressurizing the vacuum chamber; charging a selected quantity of ink into the ink bag; sealing the open end of the ink bag at a second position below the first position; pressing the sealed portion of the ink bag to a selected thickness with press plates; sealing the bag in the pressed position at a third position below the second position; and cutting the ink bag between the second and third positions.

11 Claims, 16 Drawing Sheets

METHOD OF MANUFACTURING AN INK CARTRIDGE FOR USE IN INK-JET RECORDER

This application is a divisional of pending U.S. application Ser. No. 09/306,651, filed May 6, 1999, which is a divisional of U.S. application Ser. No. 08/969,326, filed Nov. 13, 1997, now U.S. Pat. No. 5,950,403 the entire contents of which are hereby incorporated by reference.

BACKGROUND OF THE INVENTION

The present invention relates to an ink cartridge which is removably attached to an enclosure of an ink-jet recorder and supplies ink to a recording head, and more particularly, to a method of manufacturing an ink cartridge comprising a flexible ink bag housed in a hard case.

A conventional ink jet printer includes an ink container carried by a carriage equipped with an ink jet recording head. Ink droplets are produced by supplying to the recorder head ink that has been pressurized within a pressure generation chamber located within the ink container via a tube. However, when the carriage is pivoted, shaken or caused to travel during printing, the movement can cause the ink to become frothy or foamy. This, in turn, may result in a change in head pressure or cause print failures. Specifically, if ink contains gas bubbles, the pressure at which the ink is under drops, thereby decreasing the ability to eject ink droplets. For this reason, dissolved air must be eliminated from the ink.

Accordingly, it is desirable to develop a method for manufacturing an ink jet cartridge for use in an ink jet recorder, that overcomes disadvantages and limitations of existing methods. The present invention has been contrived in view of drawbacks in the prior art, and an object of the present invention is to provide a manufacturing method that enables efficient and more simple manufacture of an ink cartridge for use in an ink jet recorder.

SUMMARY OF THE INVENTION

Generally speaking, in accordance with the invention, a method of manufacturing an ink cartridge for use in an ink jet recorder, is provided. An ink bag, having a top end, and a bottom end below the top end, the top end being open and the bottom end having an ink feed port, can be hung from a first position near a top edge thereof and positioned in a vacuum chamber. The vacuum chamber can be depressurized, upon which a selected quantity of ink can be charged into the ink bag. The open end of the ink bag can be sealed at a second position below the first position, and the sealed portion of the ink bag pressed to a selected thickness with press plates. The ink bag can be sealed at a third position below the second position, and thereafter cut between the second and third positions.

Accordingly, it is an object of the present invention to provide a method of manufacturing an ink cartridge which permits efficient filling of degassed ink into an ink bag of an ink cartridge used in an ink-jet recorder that can withstand handling during distribution and use, as well as recycling.

Another object of the present invention is to propose a method of recycling a comparatively expensive ink container.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to following description taken in connection with the accompanying drawings, in which.

DETAILED DESCRIPTION OF PREFERRED EMBODIMENTS

Figure 1:
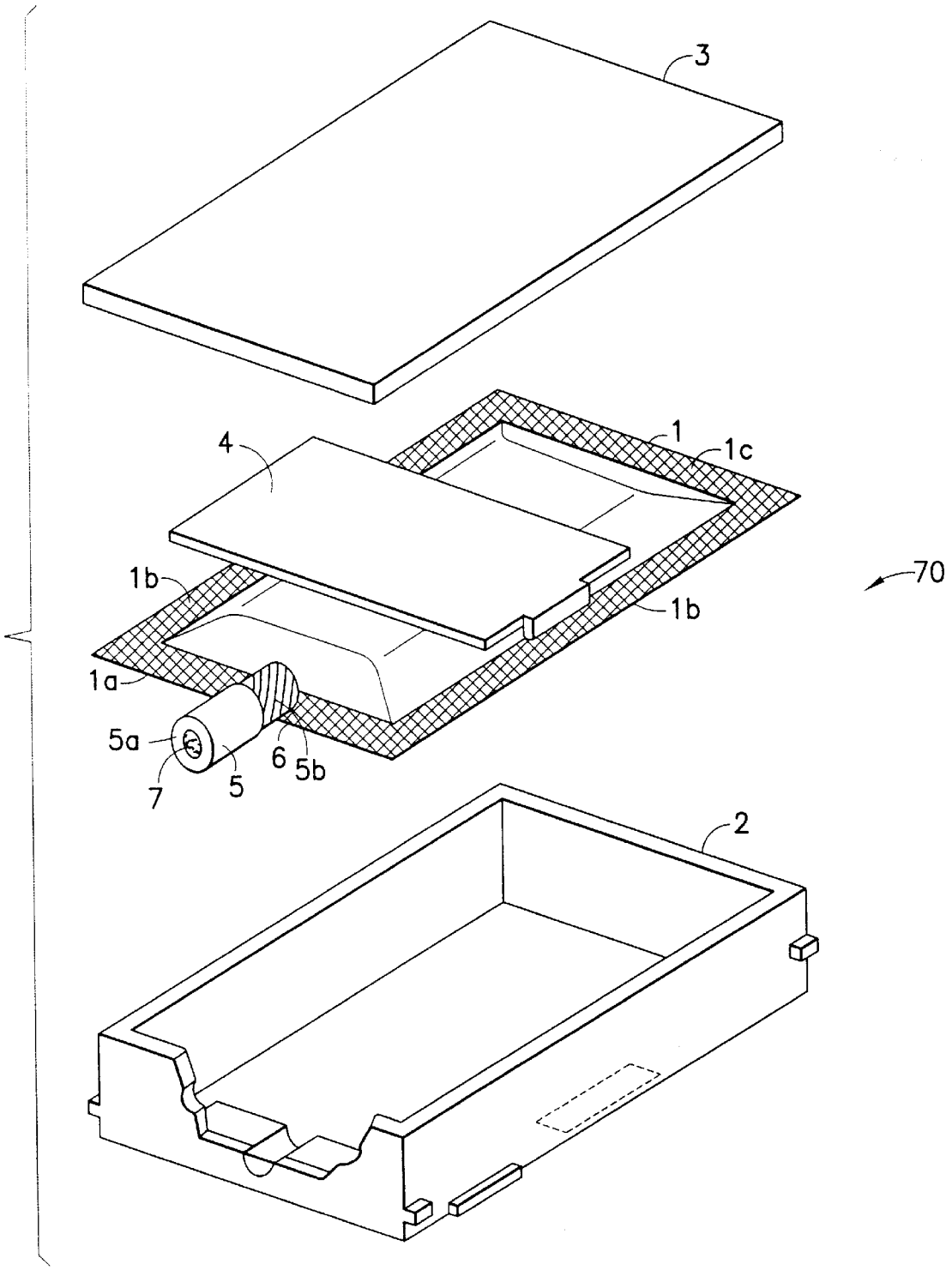
FIG. 1 is a perspective exploded view showing ink cartridge according to one embodiment of the present invention.

Reference is made to FIG. 1, which shows an ink cartridge 70 manufactured by a method in accordance with an embodiment of the present invention. Ink cartridge 70 includes a case body 2, an elastic ink bag 1, having ink sealed therein, designed to be accommodated within case body 2, and a cover 3 for covering case body 2. An ink detection plate 4 is provided preferably between ink bag 1 and cover 3, and includes a detector (not shown) for detecting when ink bag 1 no longer contains a sufficient quantity of ink and for activating an indicator (not shown) that indicates that ink bag 1 is empty.

Figure 4:
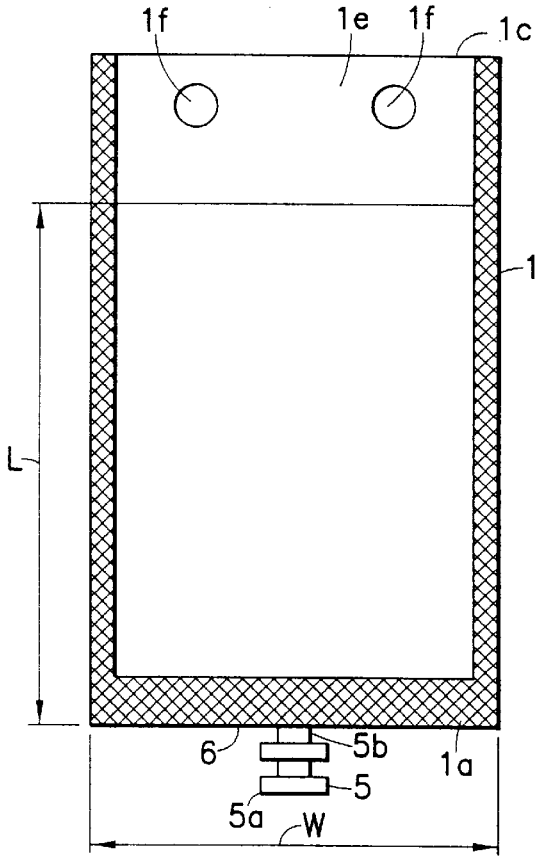
FIG. 4 is a front elevational view showing one embodiment of an ink bag prior to being charged with ink.

As shown in FIG. 4, ink bag 1 is preferably formed in a rectangular shape, having a width W and an ink level length L when charged. As such, referring to FIG. 1, ink bag 1 includes two longitudinal sides 1*b*, and an inlet side 1*c* and an outlet side 1*a* positioned between longitudinal sides 1*b*. Longitudinal sides 1*b* are preferably the same length, and are preferably longer than inlet side 1*c* and outlet side 1*a*.

Figure 1A:
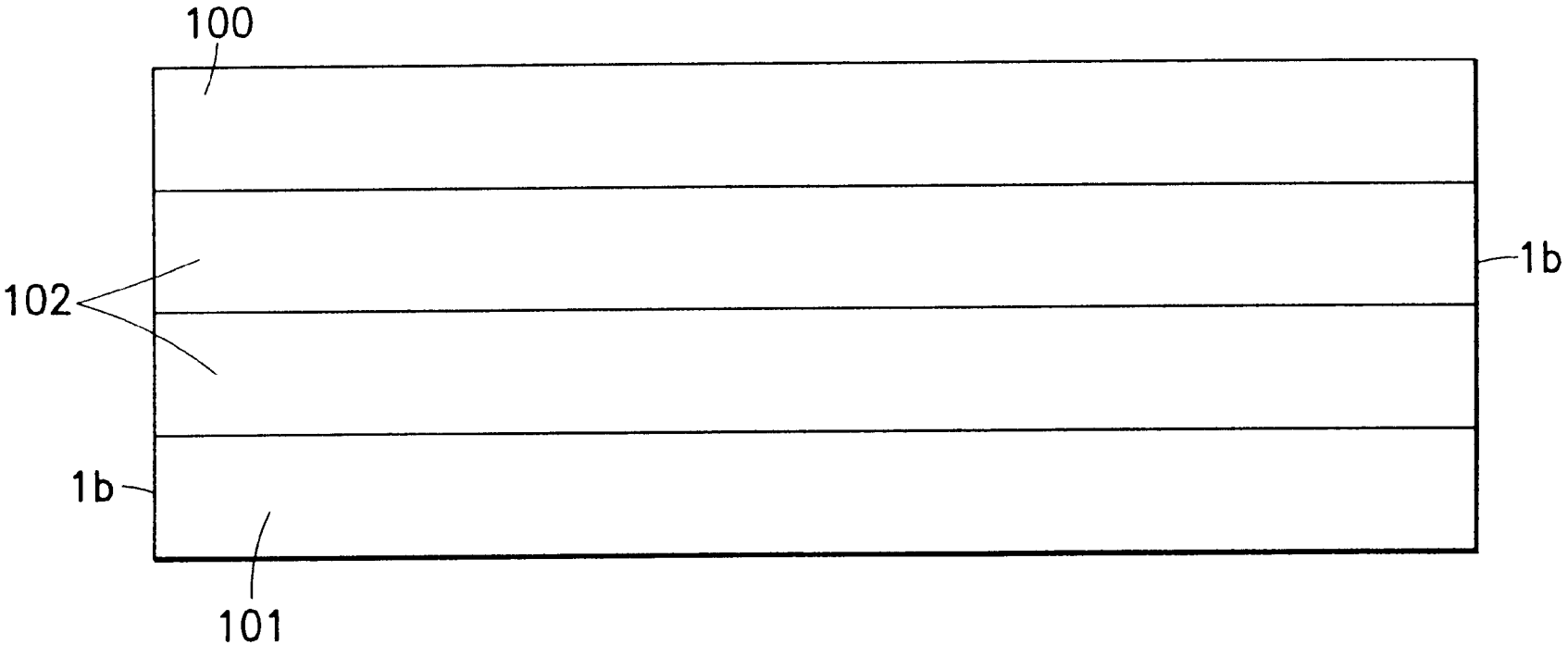
FIG. 1A is a cross-sectional view showing an ink bag of the ink cartridge depicted in FIG. 1.

In a preferred embodiment, ink bag 1 is formed by overlaying superimposing two outer films 100, 101, one on top of the other. Each outer film 100, 101 is formed of an aluminum laminate, and includes two layers, preferably, an outer nylon layer and an inner polyethylene layer. Inner films 102, preferably formed of aluminum foil, are interposed adjacent to the inner surface of the outer films 100, 101, and create an air-tight seal when heat-welded. Referring to FIG. 1A, films 100, 101, 102 are layered, for example, such that layer 100 is superimposed on inner films 102, which are superimposed on outer layer 102. Ink bag 1 is preferably formed by thermally welding films 100, 101 and 102 at longitudinal sides 1*b*. Ink bag 1 includes a port 5, preferably formed of a plastic, which is thermally welded to ink bag 1 at a base 6 of outlet side 1*a*. Base 6 functions to impart rigidity to ink bag 1. Port 5 is sealed at its free end with a septum 7, which is formed from a resilient material, such as rubber, and is inserted into port 5. Port 5 elastically engages an ink feed needle (not shown) during the printing process.

Figure 2:
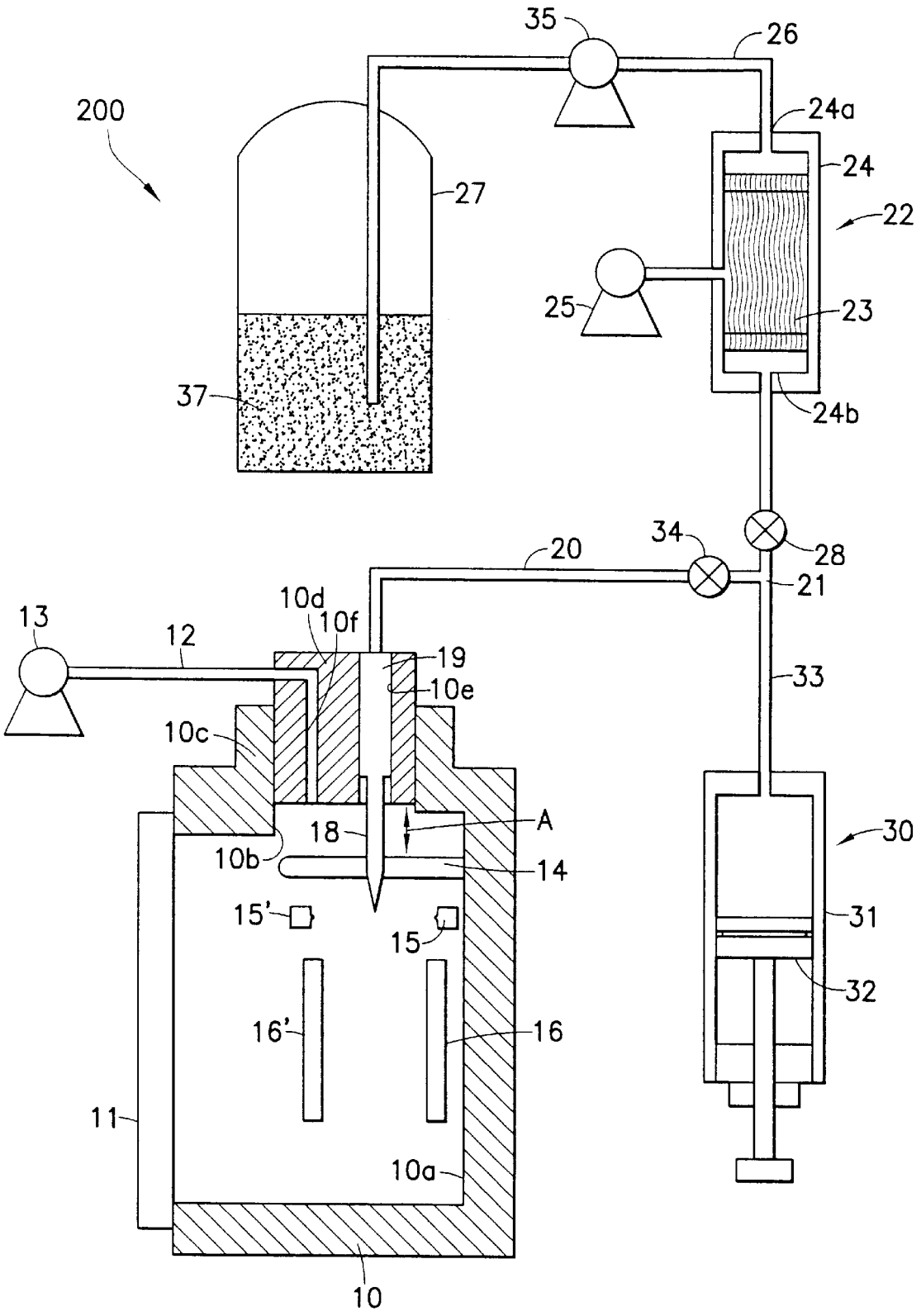
FIG. 2 is a block diagram showing one embodiment of an ink filling apparatus in accordance with the ink cartridge manufacturing method of the present invention.

A method of manufacturing ink cartridge 70 will now be described. Referring to FIG. 2, an ink filling apparatus 200 constructed in accordance with one embodiment of the present invention, is shown. Ink filling apparatus 200 includes a vacuum chamber 10 having one side that can be opened or closed by a door 1. Vacuum chamber 10 is in fluid communication via a channel 12 to a vacuum pump 13, which upon activation depressurizes vacuum chamber 10 to a predetermined vacuum pressure. Vacuum chamber 10 includes two support rods 14, which extend horizontally from an inner surface 10*a* of vacuum chamber 10. Ink filling apparatus 200 also includes heat welders 15, 15' and press plates 16, 16' positioned below support rods 14 within chamber 10.

A through hole 10*b* is formed in a top wall 10*c* of vacuum chamber 10. A manifold 10*d* includes a channel 10*e* and a channel 10*f*. A needle inserter 19 is disposed within channel 10*e* and is connected at one end to an ink feed needle 18. Ink feed needle 18 is disposed within vacuum chamber 10, and is vertically positioned by needle inserter 19 in a direction indicated by double arrow A. Needle inserter 19 is in fluid communication with a branch pipe 21 via a tube 20.

Ink filling apparatus 200 also includes a gas-liquid separation unit 22. In one preferred embodiment of the invention, gas-liquid separation unit 22 includes a hollow yarn bundle 23, which is preferably connected fluid-tight at both longitudinal ends to a cylinder 24 so as to permit fluid to flow therethrough. Cylinder 24 is connected to a vacuum pump 25 so as to produce negative pressure around the outer periphery of yarn bundle 23. Cylinder 24 includes an inlet 24*a*, which is connected to an ink tank 27 having ink 37 therein, via a tube 26. and an outlet 55*b*, which is connected to branch pipe 21 via a stop valve 28. Ink 37 is pumped to gas-liquid separator unit 22 by a pump 35.

Branch pipe 21 is also connected to a measuring tube 30 via a tube 33. Measuring tube 30 includes a cylinder 31 and a piston 32, and is preferably connected to branch pipe 21 at the center of one end of cylinder 31.

Figure 3:
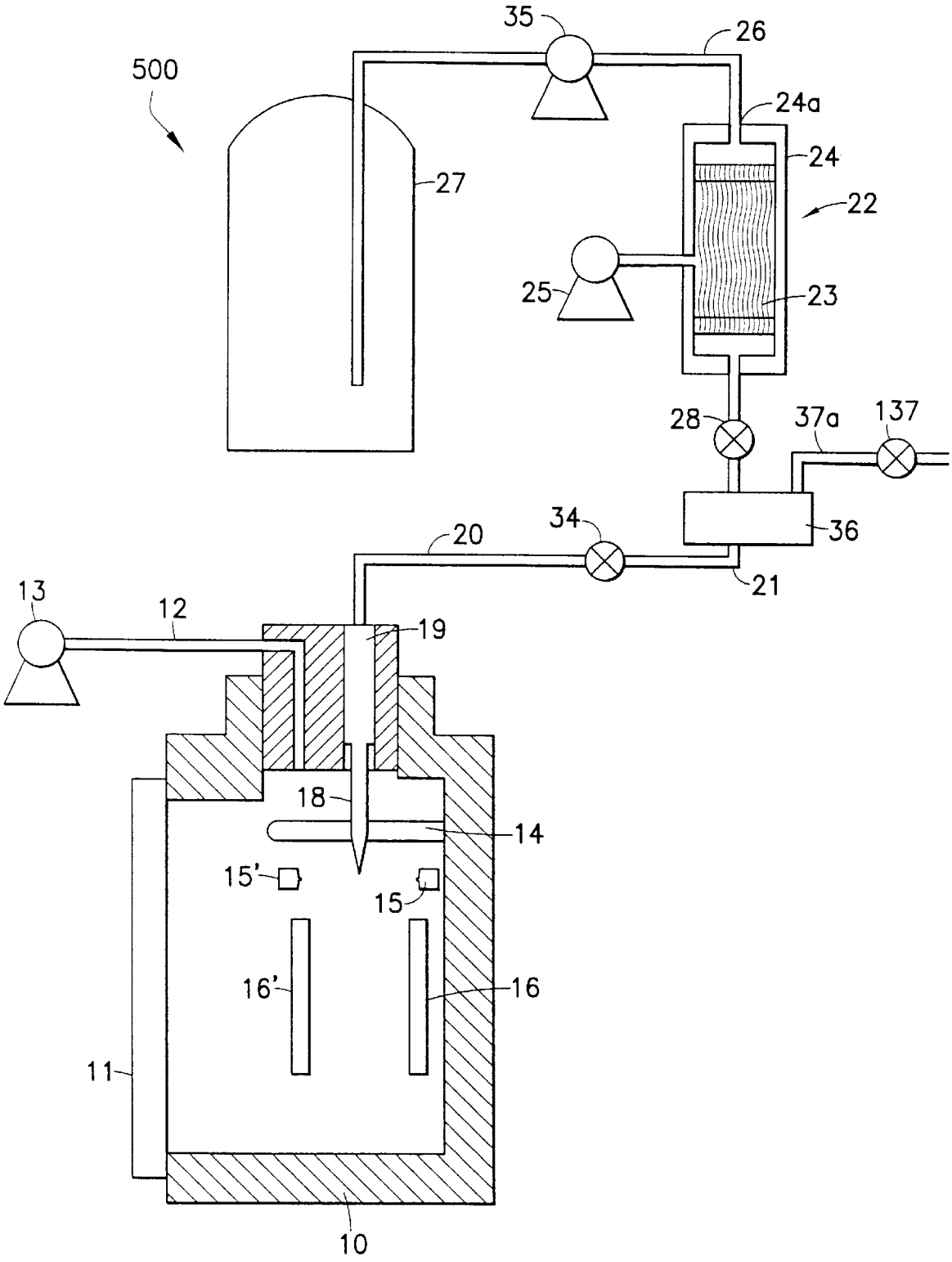
FIG. 3 is a block diagram showing a second embodiment of an ink filling apparatus in accordance with the ink cartridge manufacturing method of the present invention.

Referring now to FIG. 3, a second embodiment of an ink filling apparatus 500 constructed in accordance with the invention, is shown where like elements are indicated by like reference numerals. Ink filling apparatus 500 includes a dispenser 36 for metering the quantity of ink 37 to be filled into ink bag 1. Dispenser 36 is disposed between stop valve 34 of tube 20 and stop valve 28 provided downstream of outlet 24*b*. A valve 37 is in fluid communication with dispenser 36 via a tube 37*a*. Valve 37 is opened to ambient air when dispenser 36 has metered a specified quantity of ink. Ink is fed into ink bag 1 from dispenser 36 by means of the pressure differential between the ambient pressure and the pressure in vacuum chamber 10.

Referring to FIG. 2, 1 method of filling ink into ink bag 1 in accordance with a first embodiment of the invention will be described with reference to ink filling apparatus 200. Referring now to FIGS. 4, port 5 includes a free end 5*a* and a fixed end 5*b*, and is attached to outlet side 1*a* of ink bag 1 by heat-welding base 6 of outlet side 1*a* about fixed end 5*b* of port 5. At the same time, the remainder of outlet side 1*a* is heat-welded. Free end 5*a* is fitted with septum 7 to form a seal. Next, inlet side 1*c* of ink bag 1 is opened, and a plurality of through holes 1*f* are formed in the vicinity of opening 1*e*.

Figure 5A:
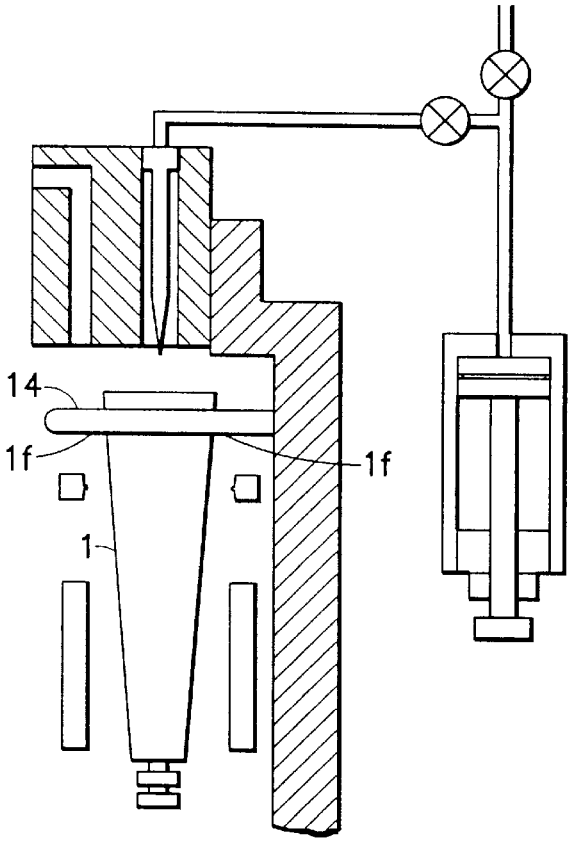
FIGS. 5A and 5B are schematic representations showing a step of hanging the ink bag in accordance with an ink cartridge manufacturing method of the present invention.
Figure 5B:
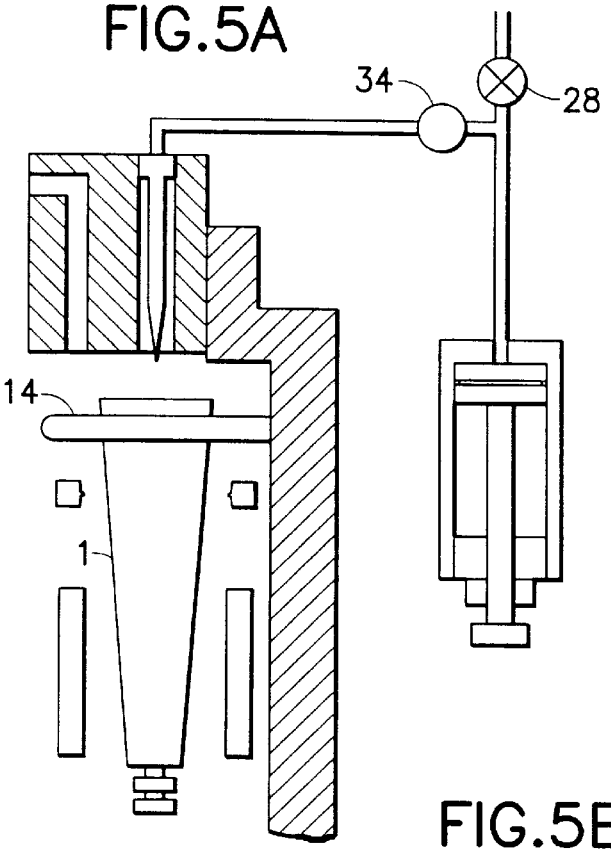

As shown in FIG. 5*a*, ink bag 1 is hung from support rods 14 by sliding through holes 1*f* over support rods 14 such that opening 1*e* of ink bag 1 is in a spread position. Subsequently, door 11 is closed to form a vacuum chamber 10, stop valve 28 connected to gas-liquid separation unit 22 is closed, and stop valve 34 is opened as is shown in FIG. 5(B). Vacuum pump 13, which is connected via channel 12 to chamber 10, is then activated to depressurize chamber 10, tubes 20 and 33, and measuring tube 30 to a predetermined pressure.

Figure 6A:
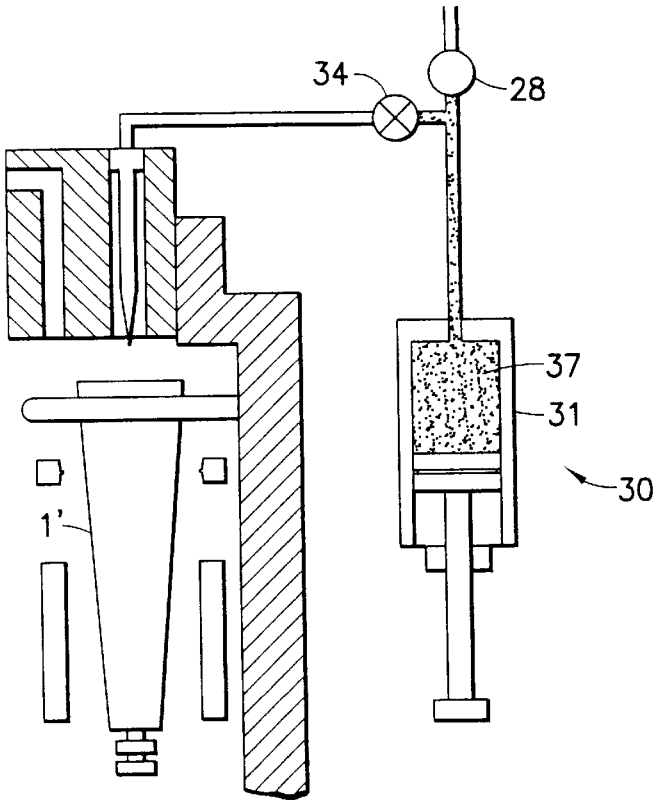
FIGS. 6A and 6B are schematic representations showing preliminary steps of filling ink into the ink bag in accordance with an ink cartridge manufacturing method of the present invention.

Referring to FIG. 6A, when vacuum chamber 10 and tubes 20, 30 and 33 have been evacuated to a predetermined pressure, stop valve 34 is closed. Thereafter, measuring tube 30 is placed in fluid communication with gas-liquid separation unit 22 by opening stop valve 28, and a predetermined quantity of ink 37 is filled into measuring tube 30. Since gas-liquid separation unit 22 is connected close to measuring tube 30, ink flows into measuring tube 30 immediately after having been degassed by gas-liquid separation unit 22. In conjunction with this operation, as is shown in FIG. 6B, needle inserter 47 is lowered such that injection needle 18 is in part disposed within ink bag 1.

Figure 6B:
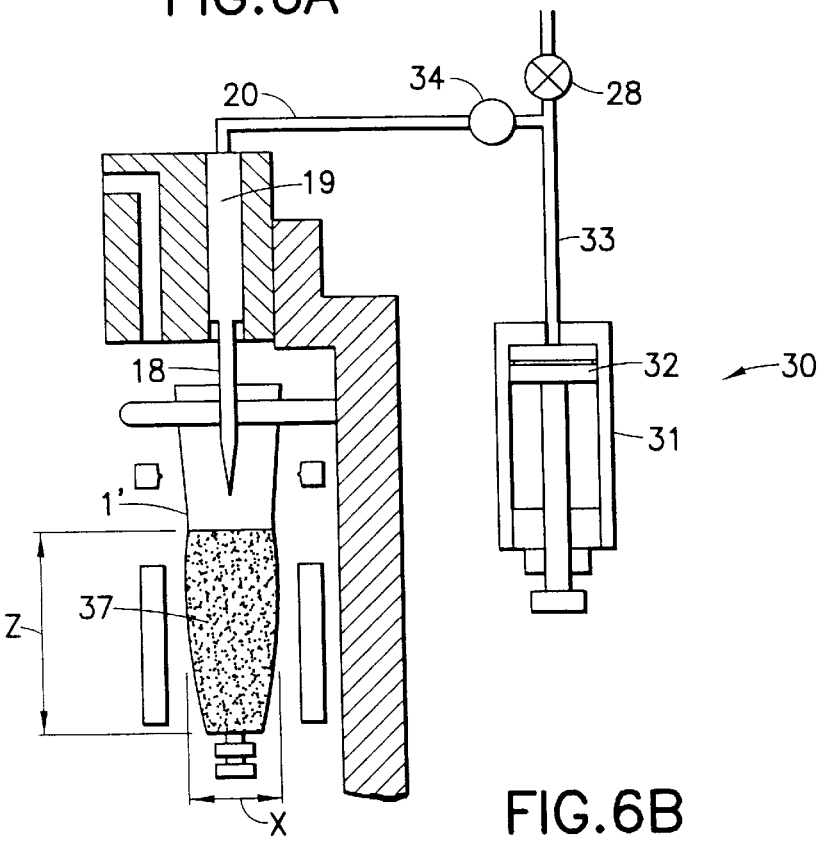
Figure 7A:
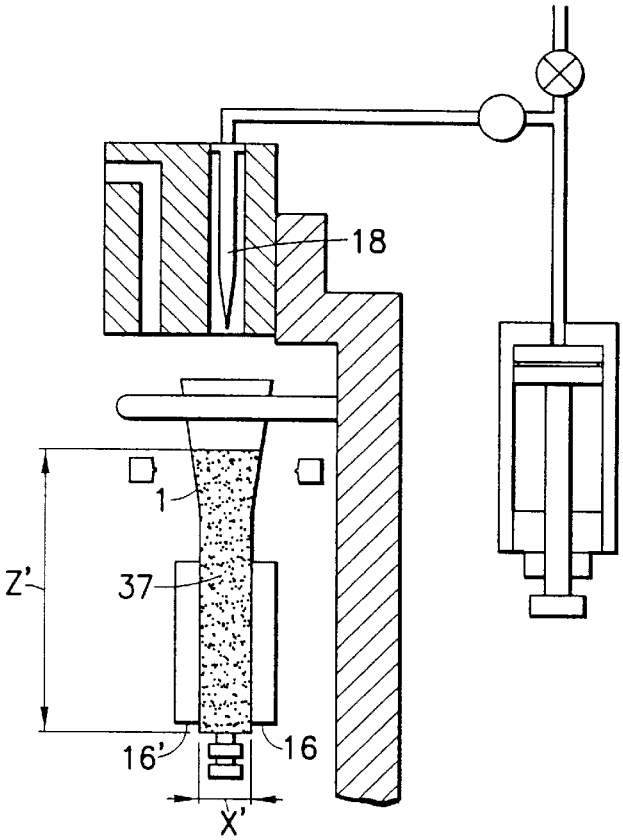
FIGS. 7A and 7B are schematic representations showing the initial steps of filling ink into the ink bag in accordance with an ink cartridge manufacturing method of the present invention.

Next, as shown in FIG. 6B, stop valve 28 is closed to isolate gas-liquid separation unit 22, stop valve 34 is opened, and piston 32 of measuring tube 30 is pressed to discharge the predetermined quantity of ink 37 into ink bag 1 via tube 33, tube 51 and needle inserter 19. After ink bag 1 has been filled with ink 37, needle inserter 19 is activated to withdraw ink feed needle 18 from ink bag 1 to an upper position recessed within channel 19. Press plates 16, 16' are then moved by a presser (not shown) to compress ink bag 1 from a thickness shown as X in FIG. 6B to a predetermined thickness X' as shown in FIG. 7A. Accordingly, the level of ink 37 contained in ink bag 1 rises from a level Z as shown in FIG. 6B to a level Z' as shown in FIG. 7A. At level Z', the quantity of ink 37 contained within ink bag 1 is slightly more than that contained in a completed product.

Figure 7B:
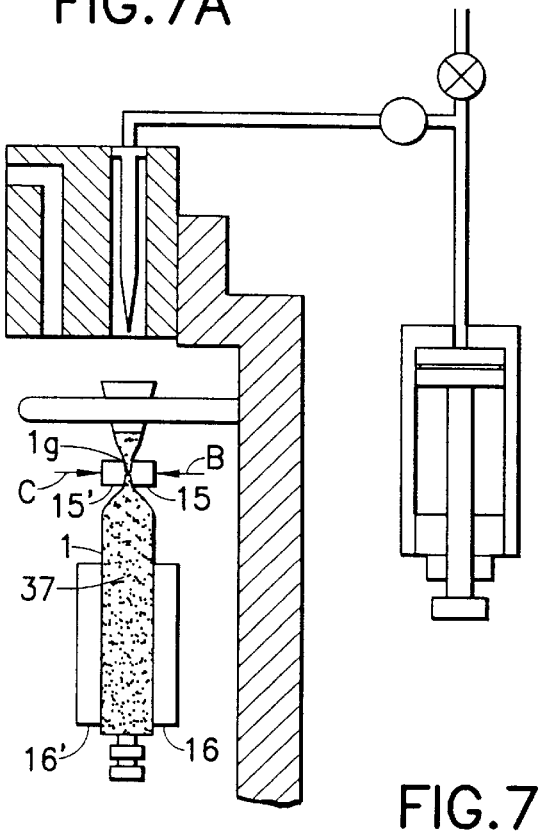

At this point, as shown in FIG. 7B, an upper portion 1*g* of ink bag 1 is pinched by heat welders 15, 15' which are moved in a direction indicated by arrows B and C, respectively, thereby sealing ink bag 1 at first seal location 1*g*. If, at this stage of the ink-filling process, ink bag 1 was permanently sealed, a small amount of air would be sealed together with ink 37. Accordingly, further steps are taken to prevent air from being trapped in sealed air bag 1.

Figure 8A:
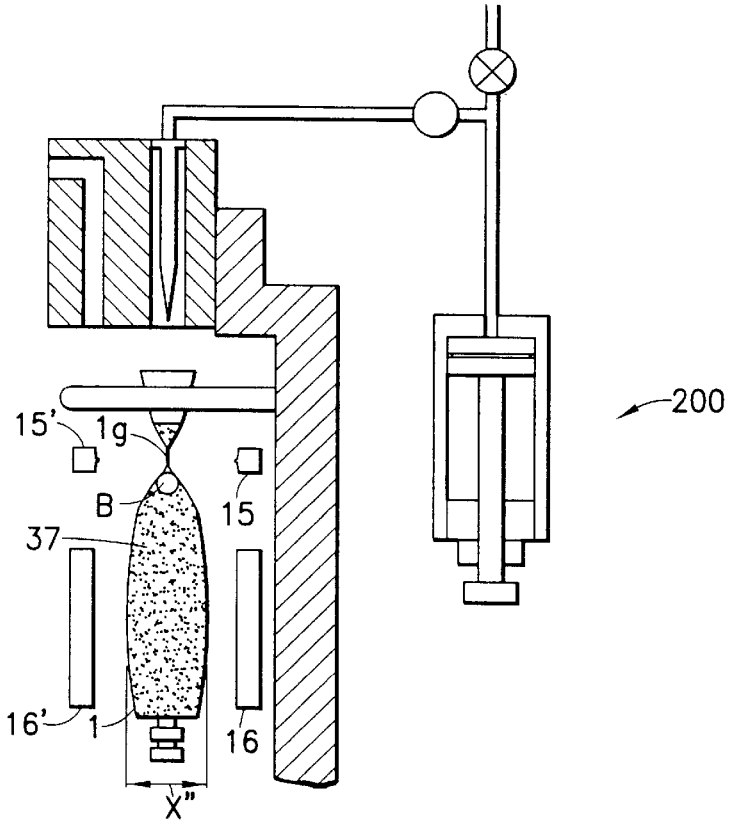
FIGS. 8A and 8B are schematic representations showing the final steps of filling ink into the ink bag in accordance with an ink cartridge manufacturing method of the present invention.
Figure 8B:
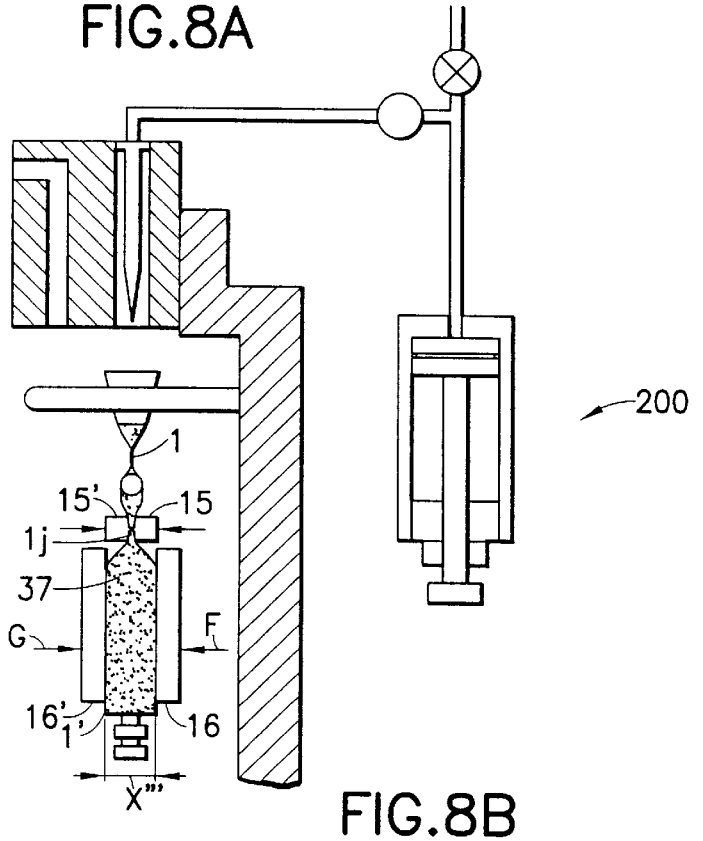

After the initial sealing operation, as is shown in FIG. 8A, press plates 16, 16' and heat welders 15, 15' are moved back to their original positions to permit air bubbles to aggregate just below first seal position 1*g* of ink bag 1. When press plates 16, 16' are retracted, ink bag 1 assumes a more rounded form, having a thickness X". At this point, as is shown in FIG. 8B, ink bag 1 is again pressed to a predetermined thickness by moving press plates 16, 16' in directions indicated by arrows F and G, respectively, by a presser (not shown) to compress ink bag 1 to a predetermined thickness X'".

Figure 9:
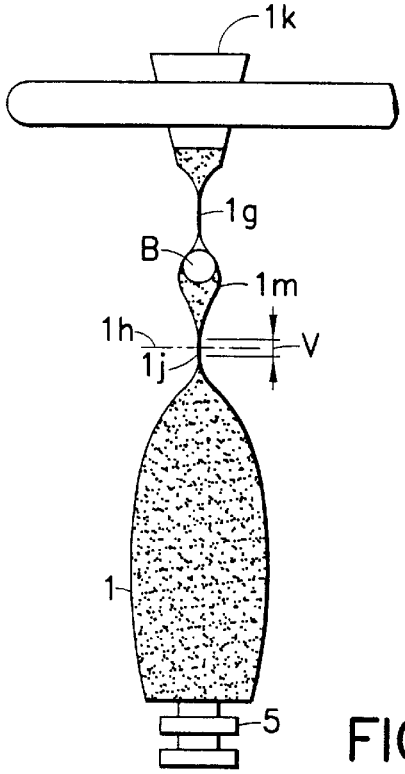
FIG. 9 is a schematic representation showing the ink bag in its final sealed condition in accordance with an ink cartridge manufacturing method of the present invention.

Next, as is shown in FIG. 9, heat welders 15, 15' pinch ink bag 1 at a second seal position 1*j*, located below first seal position 1*g*, and permanently seal ink bag 1 by heat welding at a position 1*j* over a width V that is wider than the width of the seal at first seal position 1*g*. In this manner, ink bag 1 remains sealed even after second seal position 1*j* has been cut.

As a result of these additional steps, ink 37 is sealed within ink bag 1 having substantially eliminated air bubbles. Furthermore, ink bag 1 is sealed while it is shaped to a given thickness by means of press plates 16, 16'. As a result, ink 37 can be sealed at a given ink level, thereby making it possible to accurately charge ink bag 1 with a predetermined quantity of ink 37.

After ink bag 1 has been sealed, ink bag 1 is transported out of ink filling apparatus 200, where upon second seal position 1*j* is cut along its center line 1*h*. While section 1*j* is cut, a cup portion 1*k* is held in position such that, upon cutting section 1*j*, ink 37 is not spilled, because ink 37 is captured in cup portion 1*k* and a small bag 1*m*, formed between first seal position and second seal position 1*j*.

Figure 10:
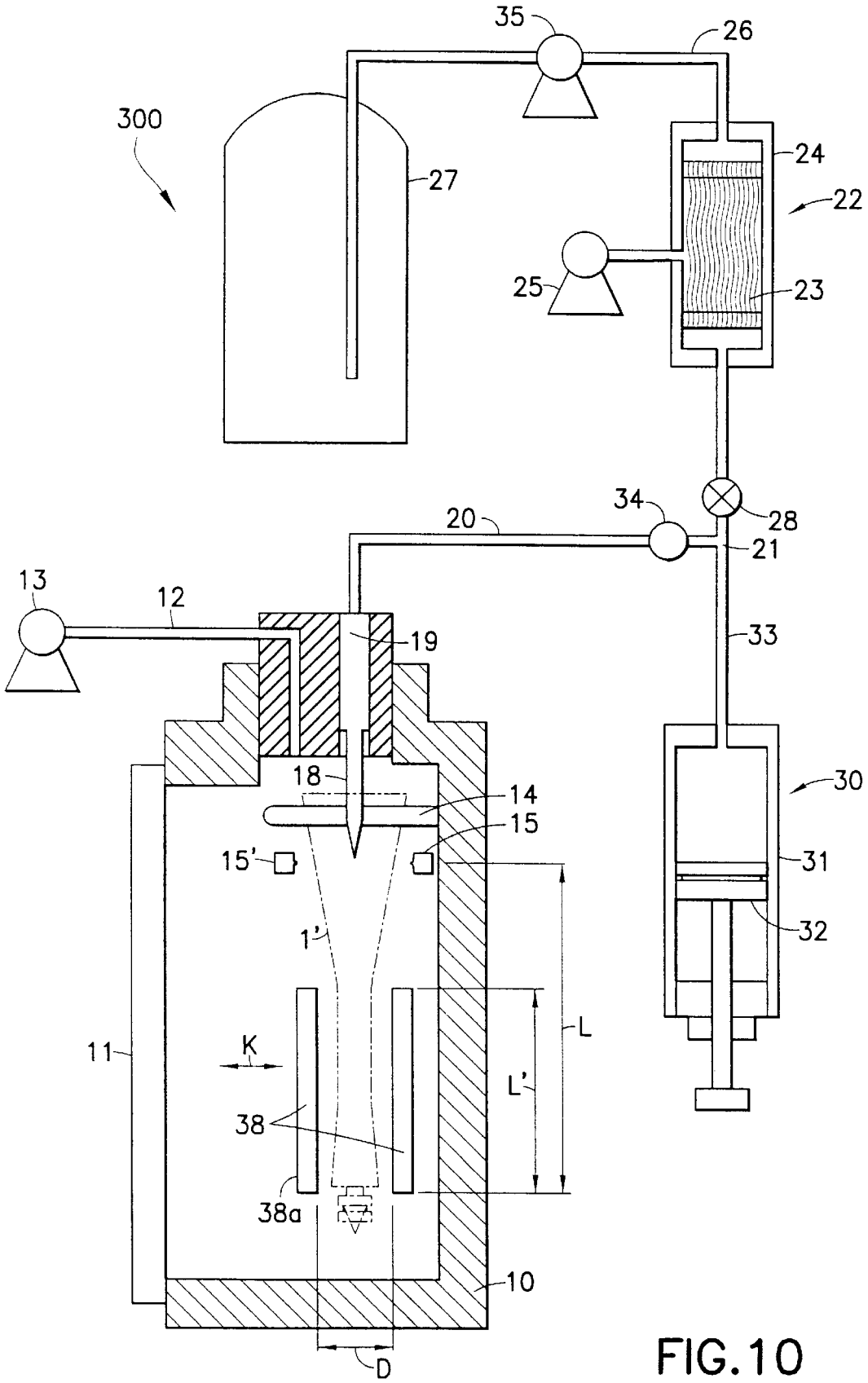
FIG. 10 is a block diagram showing a third embodiment of an ink filling apparatus in accordance with the ink cartridge manufacturing method of the present invention.

In the previously described embodiment, ink bag 1 is pressed to a width X' by press plates 16, 16' whereupon ink bag 1 is temporarily sealed below the ink level. Alternatively, ink bag 1 may also be temporarily welded at a position above ink level Z' without shaping ink bag 1.

Where an ink jet recorder is used for commercial printing or the like, a large quantity of ink is consumed. Hence, the volume of ink bag 1 is at times increased to a volume greater than three times that of an typical ink bag 1. In such a case, great water-head pressures act on a lower portion of ink bag 1 during the ink-filling step, thereby expanding the lower portion. As a result, great tensile forces act on the sealed area, thereby causing ink bag 1 to rupture under certain circumstances. Referring now to FIG. 10, a third embodiment of an ink filling apparatus 300 constructed in accordance with the invention is shown, where like elements are indicated by like reference numerals. Press plates 38 having a length L', which is at least half of length L of an ink-filled ink bag 1, are spaced apart from each other by an interval D which is less than ⅓ of width W of outlet side 1*a* of ink bag 1 shown in FIG. 4. Lower ends 38*a* of press plates 38 are positioned slightly lower than the outlet side 1*a* of ink bag 1. Press plates 38 are movable in a horizontal direction, designated by double arrow K in FIG. 10.

Referring to FIGS. 10–12, a method of filling ink into ink bag 1' in accordance with a third embodiment of the invention will be described with reference to ink filling apparatus 300. As shown in FIG. 10, ink bag 1' is hung from support rods 14 by sliding through holes If over support rods 14 such that opening 1*e* of ink bag 1' is in a spread position. Subsequently, door 11 is closed forming chamber 10, stop valve 28 connected to gas-liquid separation unit 22 is closed, and stop valve 34 is opened as is shown in FIG. 10. Vacuum pump 13, which is connected via channel 12 to chamber 10, is then activated to depressurize chamber 10, tubes 20 and 33, and measuring tube 30 to a predetermined pressure.

Figure 11A:
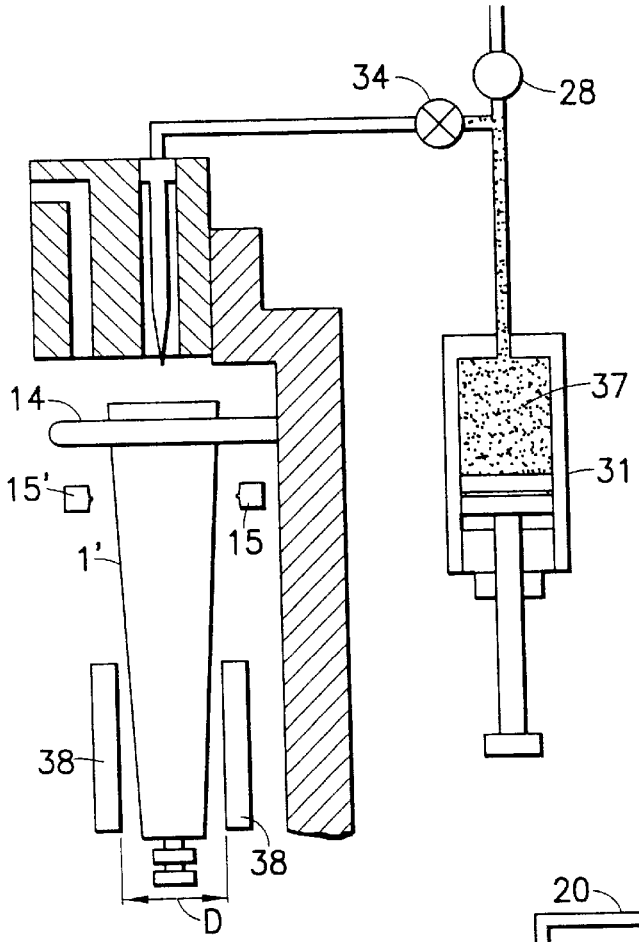
FIGS. 11A and 11B are schematic representations showing a step of positioning an ink bag and of charging the ink bag in accordance with an ink cartridge manufacturing method of the present invention.

Referring to FIG. 11A, when vacuum chamber 10 and tubes 20, 30 and 33 have been evacuated to a predetermined pressure, stop valve 34 is closed. Thereafter, measuring tube 30 is placed in fluid communication with gas-liquid separation unit 22 by opening stop valve 28, and a predetermined quantity of ink 37 is filled into measuring tube 30. Since gas-liquid separation unit 22 is connected close to measuring tube 30, ink flows into measuring tube 30 immediately after having been degassed by gas-liquid separation unit 22. In conjunction with this operation, as is shown in FIG. 11B, needle inserter 47 is lowered such that injection needle 18 is disposed within ink bag 1'.

Figure 11B:
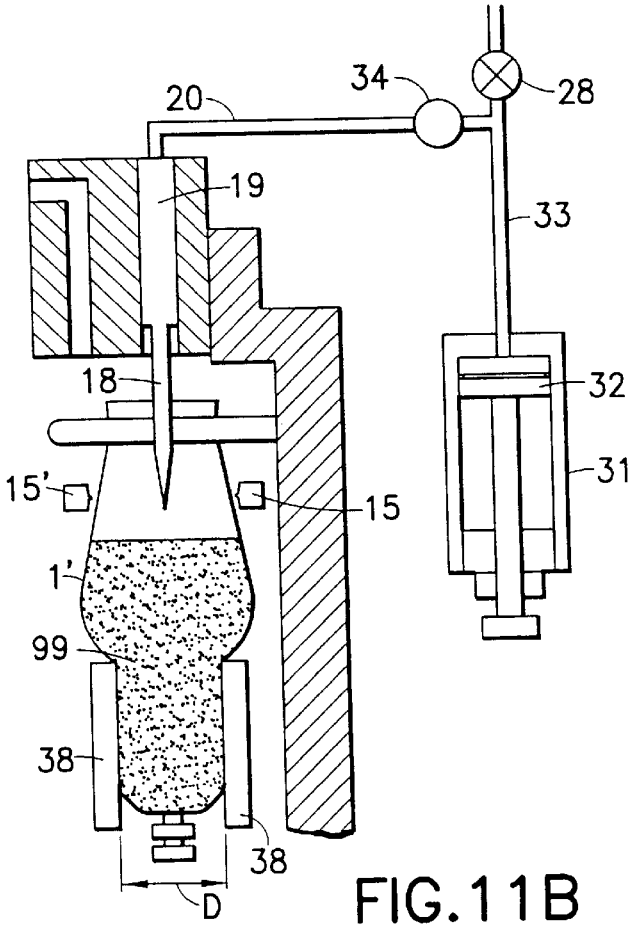

Next, as shown in FIG. 11B, stop valve 28 is closed to isolate gas-liquid separation unit 22, stop valve 34 is opened, and piston 32 of measuring tube 30 is pressed to discharge the predetermined quantity of ink 37 into ink bag 1' via tube 33 and 51, and injection needle 18.

Press plates 38 are spaced apart y approximately one-third the width of outlet side 1*a* to restrict the amount of ink 37 that enter into a lower portion 99 of ink bag 1'. Accordingly, as ink bag 1 is filled with ink, the area of ink bag 1' just above restricted lower portion 99 bulges under the weight of ink 37.

Figure 12A:
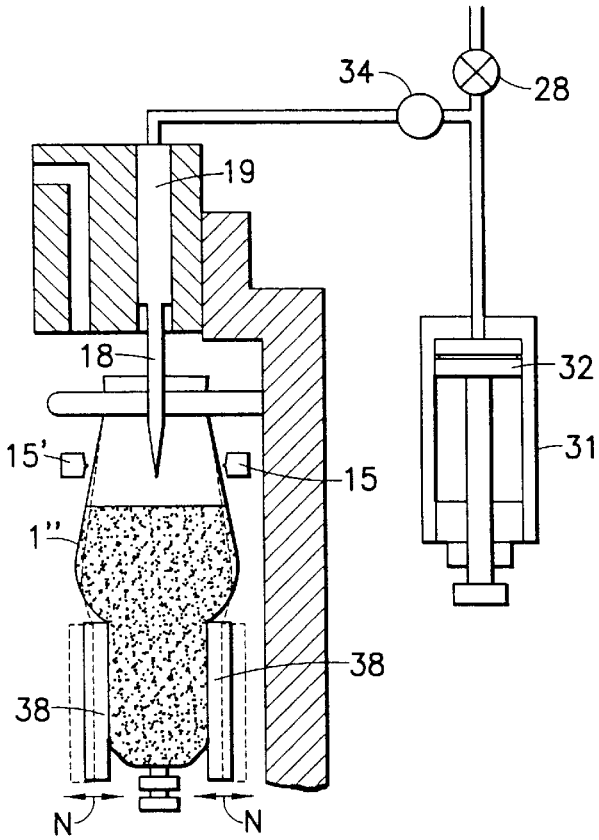
FIGS. 12A and 12B are schematic representations showing a step of sealing the ink bag during the process of manufacturing the ink bag.

As ink bag 1' is filled with ink 37, until the level of ink 37 is below heat welders 15, 15' press plates 38 are continuously moved back and forth in the direction indicated by double arrows N in FIG. 12A at an amplitude that permits press plates 38 to remain in contact with ink bag 1'. As a result, the water head pressure exerted on each portion of ink bag 1' is continuously changing, thereby preventing the formation of stress concentrations at particular points in ink bag 1'. Under the force provided by press plates 38, air bubbles escape to an upper portion of ink bag 1'.

Figure 12B:
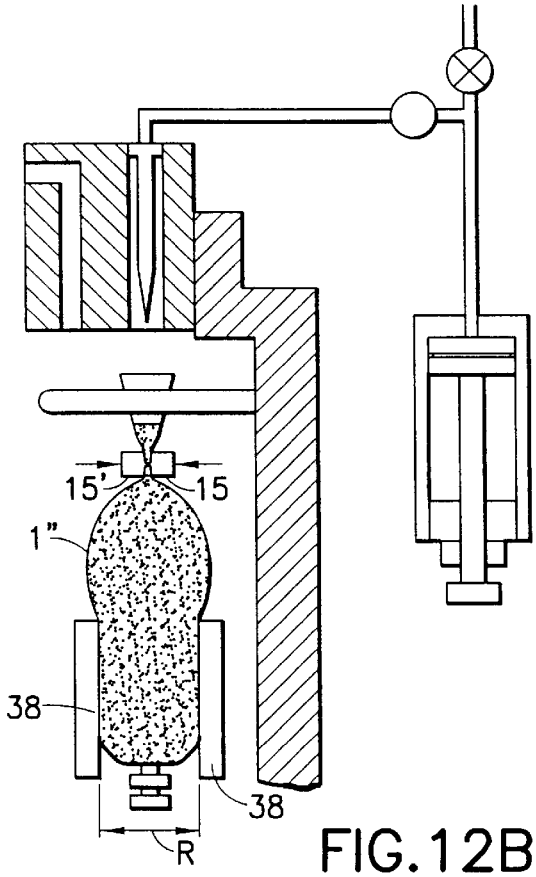

Next, as shown in FIG. 12B, needle inserter 19 is activated to withdraw ink feed needle 18 from ink bag 1' to an upper position, recessed within manifold 10*d*. Press plates 38 are then positioned to limit the lower portion of ink bag 1' to a width R, and ink bag 1' is pinched at a position slightly lower than the ink level by heat welders 15, 15' to seal ink bag 1' by heat-welding.

In accordance with this embodiment of the invention, ink bag 1' is directly and permanently sealed at a position slightly lower than the ink level. However, as in the first embodiment, the same advantageous result may be accomplished when ink bag 1' is permanently sealed at a position lower than the ink level after having been temporarily sealed at a position slightly above the ink level.

Figure 13:
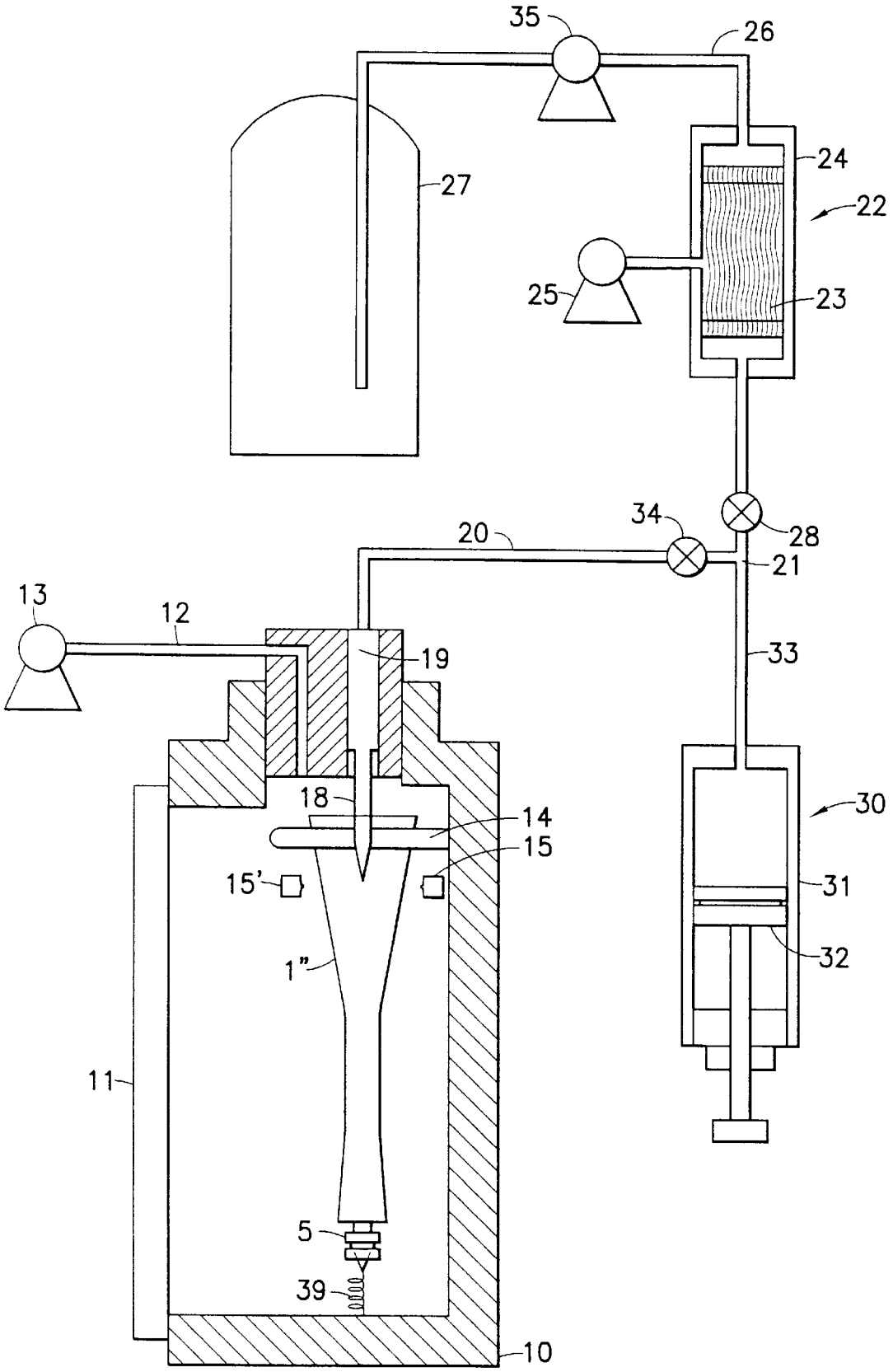
FIG. 13 is a block diagram showing a fourth embodiment of an ink filling apparatus in accordance with the ink cartridge manufacturing method of the present invention.

In another embodiment, when ink 37 is filled into ink bag", the thickness of ink bag 1" is limited by ink press plates 38 whose spacing was previously set to a predetermined distance. As shown in FIG. 13, if a tensile force is imparted to the lower a portion of ink bag 1" through the use of a spring 39, for example, ink bag 1" can be prevented from bulging. Thus, where positioning ink press plates 38 hinders the heat welding of opening 1*e* of ink bag 1, the welding operation will be facilitated by applying a tensile force to ink bag 1 to limit the thickness of ink bag 1.

Figure 14:
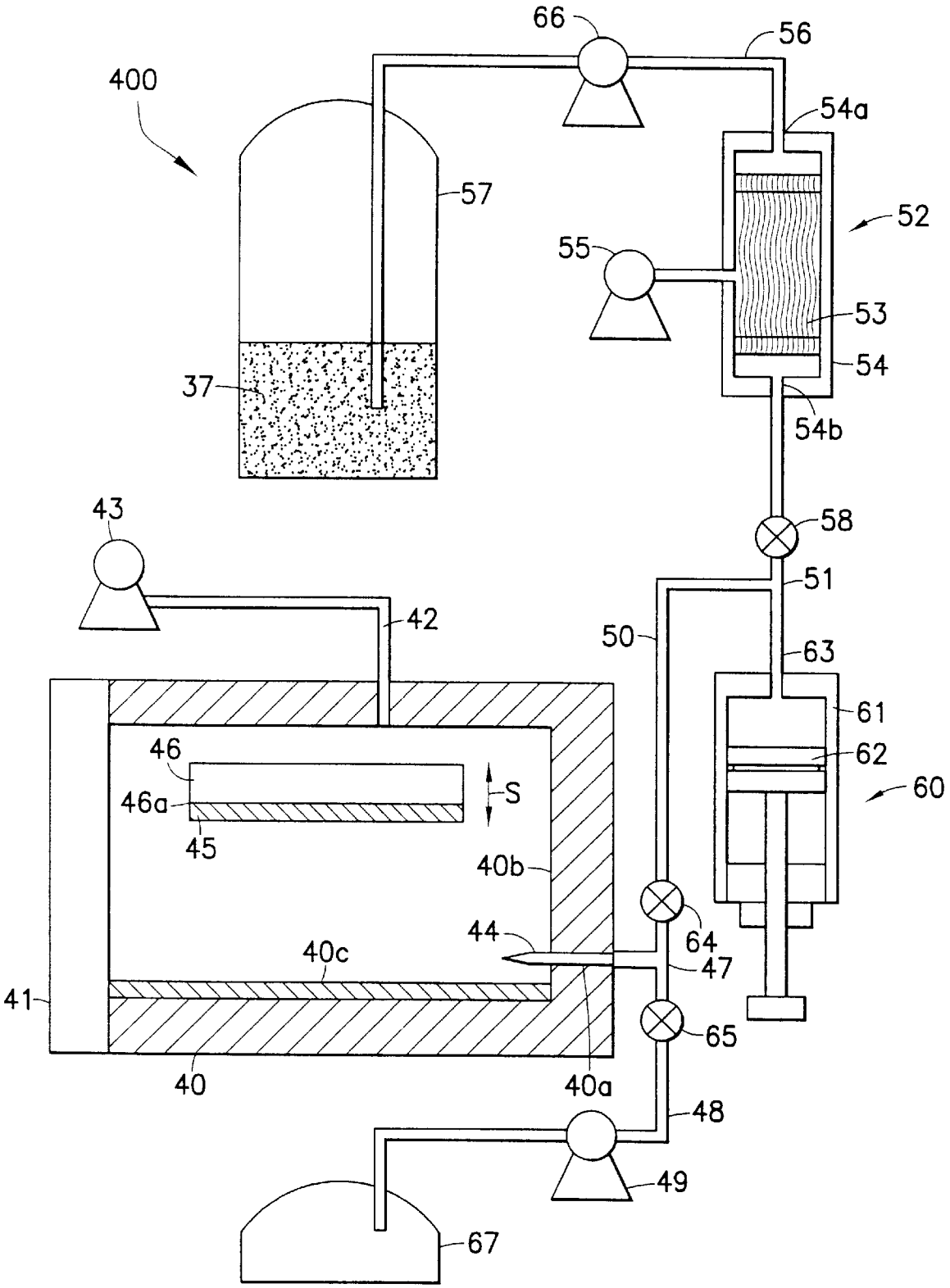
FIG. 14 is a block diagram showing a refilling apparatus in accordance with one embodiment of the present invention.

Next, a method of recycling ink cartridge 70 will be described. Referring now to FIG. 14, a refilling apparatus 400 constructed in accordance with a first embodiment of the invention, is shown. Ink refilling apparatus 400 includes a vacuum chamber 40 having one side that can be opened or closed by a door 41. Vacuum chamber 10 is in fluid communication via a channel 42 to a vacuum pump 43, which upon activation evacuates vacuum chamber 40 to a predetermined vacuum pressure.

A press plate 46, having a lower surface 46*a* to which an elastic member 45 is affixed, is disposed within vacuum chamber 40. Press plate 46 is constructed so as to be capable of moving vertically in a direction indicated as double arrow S. A through hole 40*a* is formed in a side wall 40*b* of vacuum chamber 40. Ink feed needle 44 projects from through hole 40*a*, and is disposed within vacuum chamber 40. Ink filling needle 44 is in fluid communication with a suction pump 49 via a tube 48 and a branch pipe 47, and as well as with a branch pipe 51 via a tube 50.

Ink refilling apparatus 400 also includes a gas-liquid separation unit 52. In one preferred embodiment of the invention, gas-liquid separation unit 52 includes a hollow yarn bundle 53, which is preferably connected fluid-tight at both longitudinal ends to a cylinder 54 so as to permit fluid to flow therethrough. Cylinder 54 is connected to a vacuum pump 55 so as to produce negative pressure around the outer periphery of yam bundle 53. Cylinder 54 includes an inlet 54*a*, which is connected to an ink tank 55 having ink 37 therein, via a tube 56, and an outlet 55*b*, which is connected to branch pipe 51 via a stop valve 58. Ink 37 is pumped to gas-liquid separator unit 52 by a pump 66.

Branch pipe 51 is also connected to a measuring tube 60 via a tube 63. Measuring tube 60 includes a cylinder 61 and a piston 62, and is preferably connected to branch pipe 51 at the center of one end of cylinder 61. Stop valves 64, 65 are positioned on either side of branch pipe 47. A waste ink tank 67 is connected to suction pump 49, which providing suction to tube 48.

Referring to FIG. 1, when used ink cartridges are depleted of ink and collected by a user, ink bag 1 may be removed from case body 2 and cleaned, as required. Because the amount of dissolved air remaining in recovered ink bag 1 is unknown, mixing degassed ink with recovered ink bag 1 may cause the degassed state of the ink to become unstable, thereby adversely affecting print quality. Furthermore, if an attempt is made to fill ink bag 1 that contains an unmeasured quantity of ink, the weight of the extra ink may cause ink bag 1 to rupture or an overflow condition may occur, thereby interrupting the ink filling process.

Figure 15A:
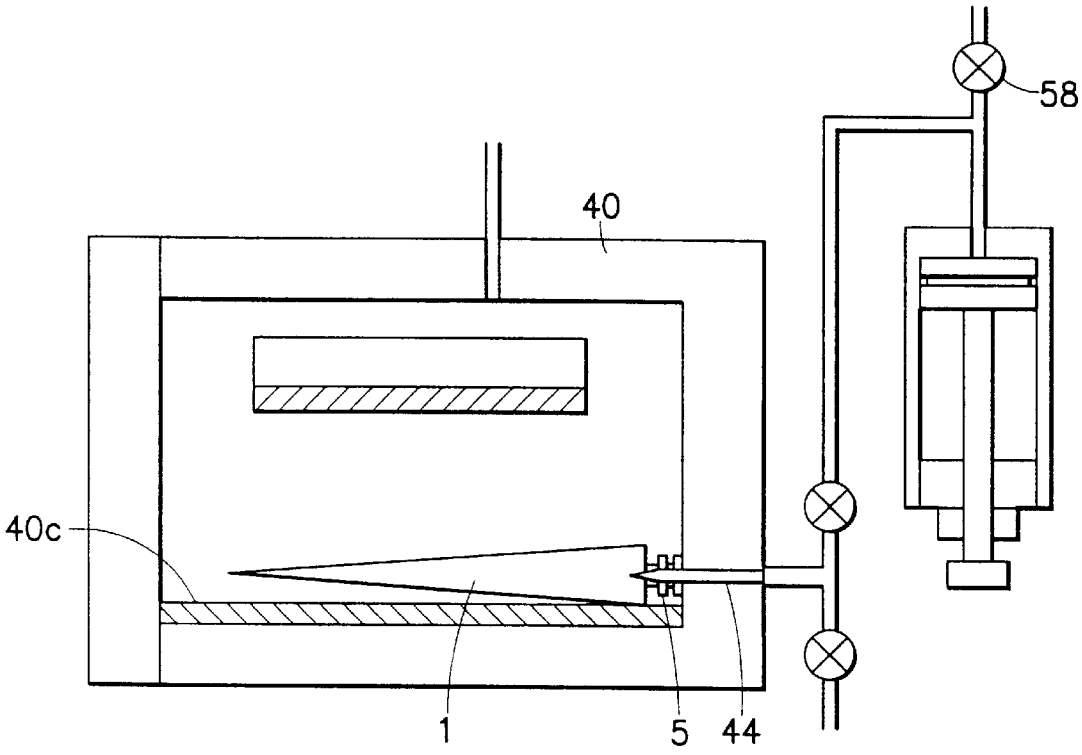
FIGS. 15A and 15B are schematic representations showing the initial steps of a process for refilling an ink bag in accordance with one embodiment of the invention.
Figure 15B:
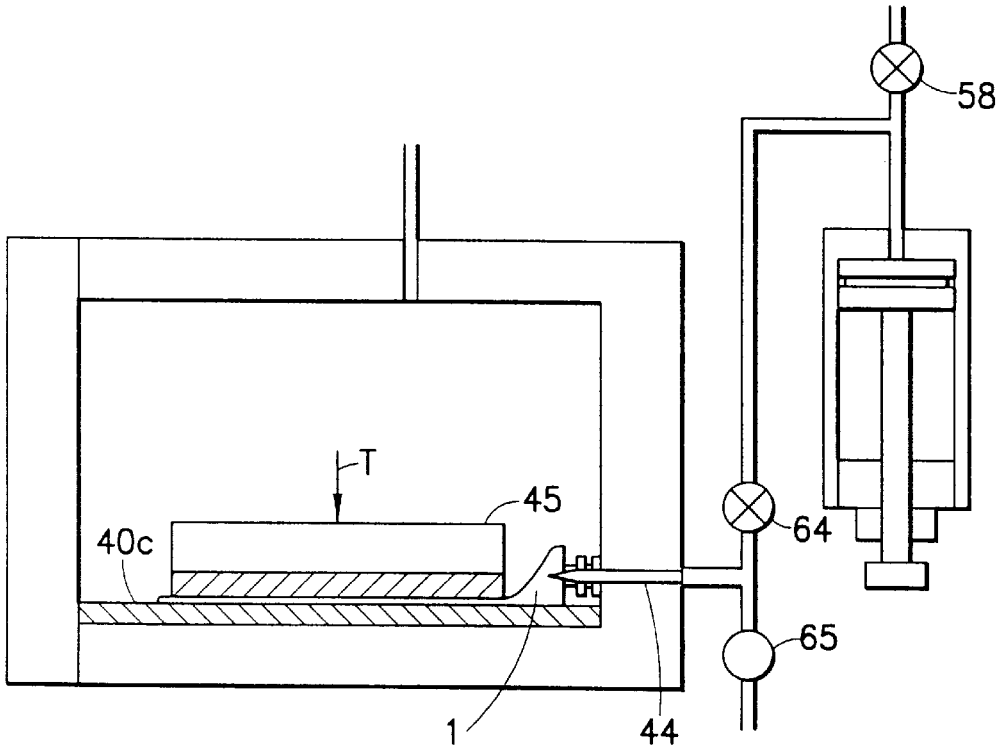

To prevent such a problem, as shown in FIG. 15A, ink filling needle 44 is inserted into septum 7 of port 5 of ink bag 1, while ink bag 1 is positioned on a surface 40*c*. Subsequently, as is shown in FIG. 15B, stop valve 64 is closed, and stop valve 65 is opened. Press plate 45 is then lowered from an upper position in a direction indicated by arrow T so as to apply a predetermined pressure on ink bag 1, and thereby bring ink bag 1 into a pressed state. In this state, the residual ink in ink bag 1 is discharged to wasted ink tank 67 through ink filling needle 44 either by operation of suction pump 49 or by compression of ink bag 1.

In one embodiment, the residual ink in ink bag 1 may immediately be reduced by applying suction to ink bag 1 while ink bag 1 is being pressed by press plate 45. In this way, ink bag 1 can be prevented from being deformed, which would occur if the residual ink is discharged solely by applying suction by suction pump 67.

Figure 16A:
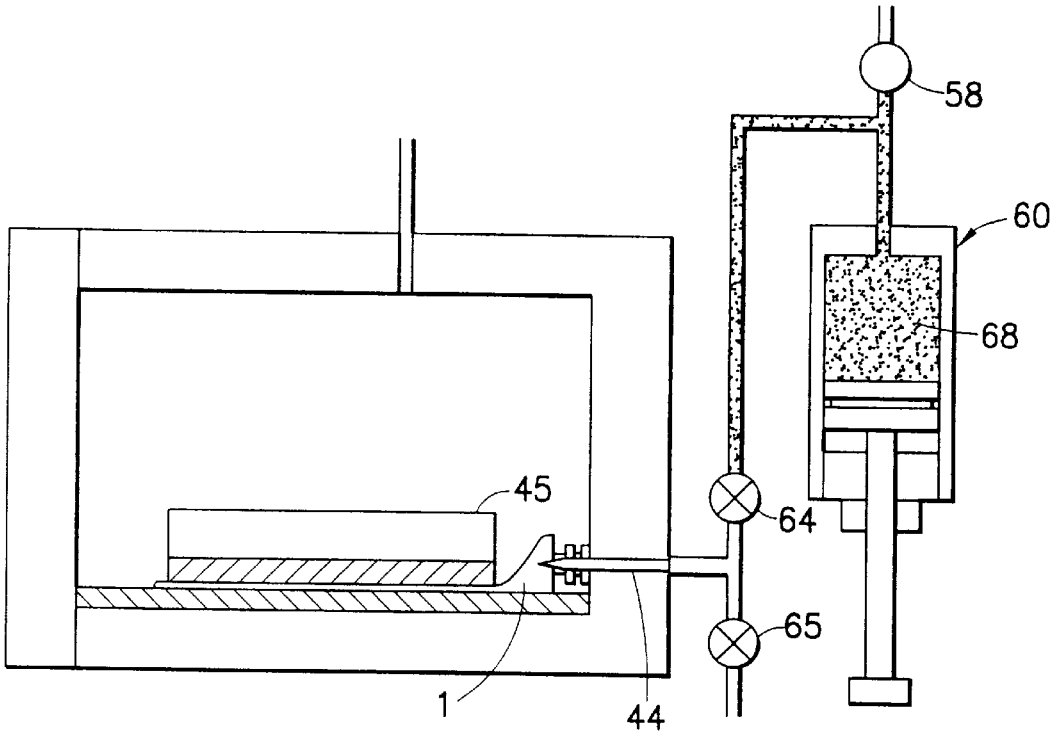
FIGS. 16A and 16B are schematic representations showing the final steps of a process for refilling the ink bag in accordance with one embodiment of the invention.

After the discharge of the residual ink from ink bag 1 is complete, stop valve 65 is closed, and valve 58 is opened, thereby dispensing a given amount of ink to measuring tube 60 from ink tank 55. Because gas-liquid separation unit 52 is connected close to measuring tube 60, ink 68 flows into gas-liquid separation unit 52 immediately after having been degassed, as shown in FIG. 16A.

Figure 16B:
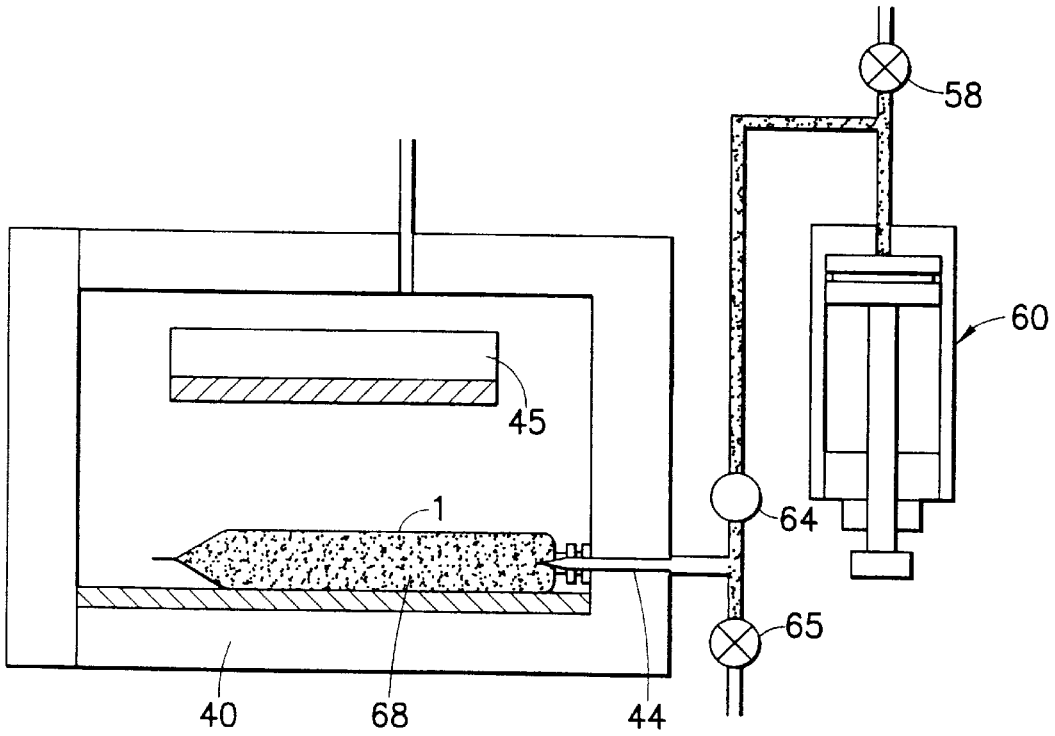

As shown in FIG. 16B, if ink 68 is pressed out of measuring tube 60 by piston 62 while press plate 45 is returned to its original position and ink bag 1 is in an open state, a measured quantity of ink 68 flows into ink bag 1. After ink bag 1 is filled with ink 68, vacuum chamber 40 is returned to ambient pressure, and ink filling needle 44 is removed from septum 7. Ink bag 1 is then removed from vacuum chamber 40.

At this stage, septum 7, which is preferably formed of an elastic member, remains seated in port 5. Accordingly, when ink filling needle 44 is removed from port 5, the hole formed in septum 7 as a result of the insertion of ink filling needle 44, is closed thereby preventing leakage of ink 68. Next, the refilled ink bag 1 is housed in its original body 2, and ink-empty detection plate 4 is re-attached to ink bag 1. Body 2 is then sealed with cover 3, thereby completing the recycling of the ink cartridge.

Although the residual ink is discharged by pressing ink bag 1 in the previous embodiment, the ink can be sufficiently discharged solely by pressing ink bag 1 to such that ink bag 1 is prevented from being deformed, which would occur if suction alone was used to discharge the ink.

Although the discharge of ink from ink bag 1 and the refilling of ink 68 into ink bag 1 are performed in a vacuum in the previous embodiment, these steps may be carried out under ambient pressure if septum 7 maintains an air-tight seal of ink bag 1.

It will thus be seen that the objects set forth above, and those made apparent from the preceding description, are efficiently attained and, because certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be the to fall therebetween.

What is claimed is:

1. A method of manufacturing an ink cartridge for use in an ink-jet recorder, comprising:

positioning an ink bag in a vacuum chamber by suspending the bag from a plurality of through holes formed in the ink bag, the ink bag having an ink feed port which had been previously thermally welded to bottom side of the ink bag at a base and is sealed with a septum, an upper side of the ink bag opposite the ink feed port side being opened, and the plurality of through holes being formed in the vicinity of the opening;

depressurizing the vacuum chamber;

filling a specified quantity of degassed ink into the ink bag while the ink bag is sandwiched in a compressed state between press members to at least one third of the width of the ink bag in an uncompressed condition; and sealing the opening of the ink bag at a position below the ink level by heat welding.

2. The method as defined in claim 1, wherein at least half of the length of the ink bag is limited in a widthwise direction by means of the press members.

3. The method as defined in claim 1, wherein the lower end of each of the press members is situated in a position below the base.

4. The method as defined in claim 1, further comprising a step of reducing or increasing the size of the ink bag by the press members after completion of the ink filling step while the ink bag is kept in contact with the press members.

5. The method as defined in claim 1, wherein the width of the ink bag is limited by pulling the ink bag in a longitudinal direction during the sealing step.

6. A method of manufacturing an ink cartridge, comprising the steps of:

(a) providing an ink bag including an outlet side and an inlet side, said outlet side having a port, said inlet side being open;

(b) hanging said ink bag with said port facing downward;

(c) charging a predetermined amount of ink to an ink level into said ink bag via said inlet side;

(d) sealing said inlet side at a position below the ink level by heat welding; and (e) accommodating said ink bag in a casing.

7. The method according to claim 6, wherein said steps of charging and sealing are conducted under a depressurized condition.

8. The method according to claim 6, wherein said step of sealing includes:

sealing said inlet side at a first portion by heat welding; and sealing said inlet side at a second position below said first position by heat welding.

9. The method according to claim 6, further comprising the step of:

cutting said inlet side subsequently to said step (d).

10. The method according to claim 6, wherein said step (d) includes sealing said inlet side at a position slightly lower than an ink level.

11. The method according to claim 6, further comprising the step of:

contacting a plate with a surface of said ink bag between said outlet and inlet sides prior to said step (d).

* * * * *